United States Patent [19]

Masuda et al.

[11] 4,147,595

[45] Apr. 3, 1979

[54] SPRINKLER FOR VENT PART OF ASCENSION PIPE OF COKE OVEN

[75] Inventors: Yukio Masuda; Hiroshi Naoi, both of Kakogawa, Japan

[73] Assignees: Kansai Netsukagaku Kabushiki Kaisha, Hyogo; Ikio Tekkosho, Fukuoka, both of Japan

[21] Appl. No.: 854,383

[22] Filed: Nov. 23, 1977

Related U.S. Application Data

[63] Continuation of Ser. No. 688,752, May 21, 1976, abandoned.

[51] Int. Cl.[2] ..... C10B 43/00

[52] U.S. Cl. ..... 202/241; 202/260; 202/263; 239/561; 239/598

[58] Field of Search ..... 239/561, 598; 202/254, 202/263, 262, 260, 241

[56] References Cited

U.S. PATENT DOCUMENTS

| | | | |
|---|---|---|---|
| 436,942 | 9/1890 | Scheen | 239/598 X |
| 947,522 | 1/1910 | Allen, Jr. | 202/260 X |
| 1,597,541 | 8/1926 | Plantinga | 202/241 X |
| 2,930,531 | 3/1960 | Kennedy, Jr. | 239/561 X |
| 3,104,672 | 9/1963 | Holdren | 239/DIG. 13 |
| 3,174,924 | 3/1965 | Clark et al. | 202/254 X |
| 3,556,948 | 12/1968 | Kinzler et al. | 202/241 X |

*Primary Examiner*—John J. Love

*Attorney, Agent, or Firm*—Oblon, Fisher, Spivak, McClelland & Maier

[57] ABSTRACT

A sprinkler for a vent secton or part of an ascension pipe of a coke oven which is disposed in the vent pipe of a horizontal coke oven chamber ascension pipe and comprises a sprinkler nozzle body which is a substantially straight pipe and is disconnectably fitted to a hole formed in the vent pipe through a male screw which is formed on an outer wall of the sprinkler nozzle body being screwed to a female screw formed around the hole in the vent pipe. One or more spray holes for spraying water in the radial direction of the axis of the nozzle body are formed at the end of the nozzle body extending into the vent pipe. A male screw, formed at the rear of the nozzle body extending outside of the vent pipe, and a branch pipe, which is branched from the main feed pipe supported on another member equipped on an oven roof, are disconnectably connected by a pipe joint member.

3 Claims, 4 Drawing Figures

SPRINKLER FOR VENT PART OF ASCENSION PIPE OF COKE OVEN

This is a continuation of application Ser. No. 688,752, filed May 21, 1976 now abandoned.

BACKGROUND OF THE INVENTION

1. Field of the Invention

The present invention relates to a sprinkler for a vent part or section of an ascension pipe of a coke oven.

More particularly, it relates to an improved sprinkler for preventing the adhesion of tar mists and fine dusts of coal and coke, which rise with the gas formed in a coke oven, on the wall of the vent part or section extending from the body of the ascension pipe for discharging the gas.

2. Description of the Prior Art

Heretofore, in order to prevent the adhesion of the above-mentioned carbon materials, a sprinkler pipe, which forms a passage by conventional circular type pipes, and the like, is fixed in the vent part of the ascension pipe and the inner wall of the vent part of the ascension pipe is covered with water lamina by spraying from many sprinkler holes in the normal state. However, the sprinkler pipe has many holes whereby there has been much trouble with clogging of the sprinkler holes because of the impurities in the water for the spray and the tar mists formed in the coke oven during the operation of the coke oven. In such cases, cleaning of the sprinkler pipe has been carried out by opening the vent hole formed in the vent after finishing carbonization in the coke oven, that is, after stopping the passage of the gas formed in the coke oven, and cleaning the sprinkler pipe by a hand operation. Obviously, the conventional operation has been low in efficiency and has been quite difficult.

SUMMARY OF THE INVENTION

It is therefore an object of the present invention to overcome the aforementioned disadvantages and to provide an improved sprinkler for the vent part of an ascension pipe in a coke oven, wherein the sprinkler pipe can be easily taken out, even during the carbonizing operation, to clean the sprinkler pipe whenever desirable.

The foregoing object, and others as well, of the invention has been attained by providing a sprinkler for a vent part of an ascension pipe of a coke oven which is disposed in the vent pipe connecting a horizontal coke oven chamber and the ascension pipe to the outside, which comprises a sprinkler nozzle body which is a substantially straight pipe and is disconnectably fitted through a hole formed in the vent pipe, a male screw or externally threaded portion being formed on an outer wall of the sprinkler nozzle body to be screwed to a female screw or internally threaded portion formed around the hole in the vent pipe, one or more spray holes for spraying water in a radial direction to the axis of the nozzle body being arranged at the one end of the nozzle body extending into the vent pipe, a male screw or externally threaded portion being formed at the rear part of the nozzle body extending out of the vent pipe, and a branch pipe which is branched from the main feed pipe supported on another member equipped on an oven roof, such that the nozzle body is readily disconnectably connected to the branch pipe through an internally threaded pipe joint member.

DETAILED DESCRIPTION OF THE PREFERRED EMBODIMENTS

Figure 1:
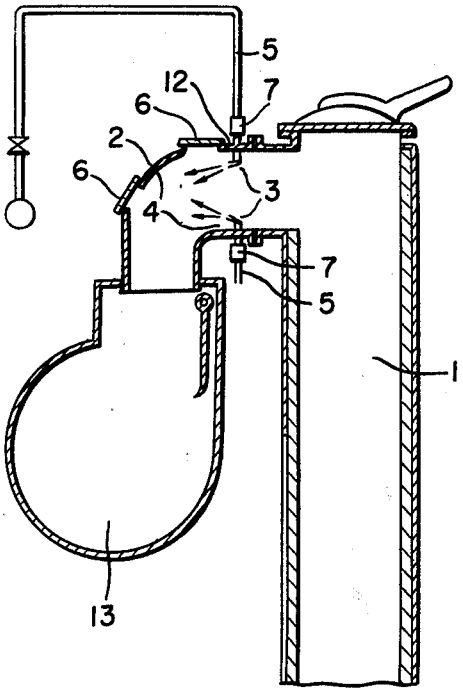
FIG. 1 is a vertical sectional side view of an ascension pipe of a Kopper's type coke oven which is equipped with a sprinkler according to the present invention.

Referring now to the drawings, the embodiments of the invention will be illustrated. In the various Figures, the reference numeral (1) designates an ascension pipe of a coke oven having a vent part (2), shown near the top end thereof, in which there are disposed sprinkler pipes (3), being connected through an inner wall (4) of the vent part of the ascension pipe to branch pipes (5). A vent hole (6) is provided in the wall of the vent part (2). The sprinkler pipes (3) and the branch pipes (5) are connected by pipe joint members (7) as unions or joints. On the inner end of the sprinkler pipes (3) there is a shielding part (8) and a sprinkler hole (9) is formed on a side surface of the inner end of the sprinkler pipe (3). A male screw or externally threaded portion (10) joins the sprinkler pipe (3) and the pipe joint member (7), while a similar male screw (11) is employed for inserting and fixing the sprinkler pipe in a threaded hole formed in a wall (12) of the vent part. The vent ultimately is connected to a collecting main pipe (13).

In the sprinkler of the present invention, each sprinkler pipe (3), which is substantially straight, is inserted through the respective hole formed in the vent part of the ascension pipe and the spray is carried out from the sprinkler hole (9) formed at the end of the sprinkler pipe to the inner surface (4) of the vent part, as shown in FIG. 1. Accordingly, the water lamina flow is always formed on the inner wall surface, whereby the adhesion of tar mist and the other carbon material can be prevented.

It is possible to disconnect the branch pipe (5) from the sprinkler pipe (3) by rotating the nut of the pipe joint (7), the branch pipe (5) being fixed, and to disconnect the sprinkler pipe (3) from the wall of the vent part by rotating the sprinkler pipe (3) and thus to easily take out or remove the sprinkler pipe (3). Cleaning of the sprinkler pipe (3) is thus easily carried out as it can be removed and done at a desirable location and time.

It is also possible to disconnect the sprinkler pipe (3) during the carbonization step. The amount of the gas leaked from the hole from which the sprinkler pipe is disconnected, in such cases, is quite small, whereby the effect of the leakage is slight and, if desirable, the hole can be covered with a cap at the time. The sprinkler hole (9) formed on the sprinkler pipe (3) is larger than the many holes formed in the conventional type pipes, for example, the circular type. Accordingly, the trouble caused by clogging of the sprinkler hole with tar mist, etc., is remarkably decreased.

The shape of the vent part of the ascension pipe is of course dependent upon the type of the coke oven. It is preferable to design the shape of the sprinkler pipe depending upon the type of vent part of the ascension pipe in order to uniformly drench the inner surface of the vent part.

Figure 2:
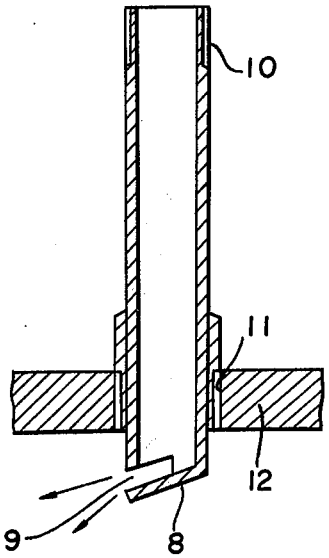
FIG. 2 is a vertical sectional side view of the nozzle of the sprinkler which is equipped mainly in the ascension pipe of a Kopper's type coke oven, as shown in FIG. 1, according to this invention.
Figure 3:
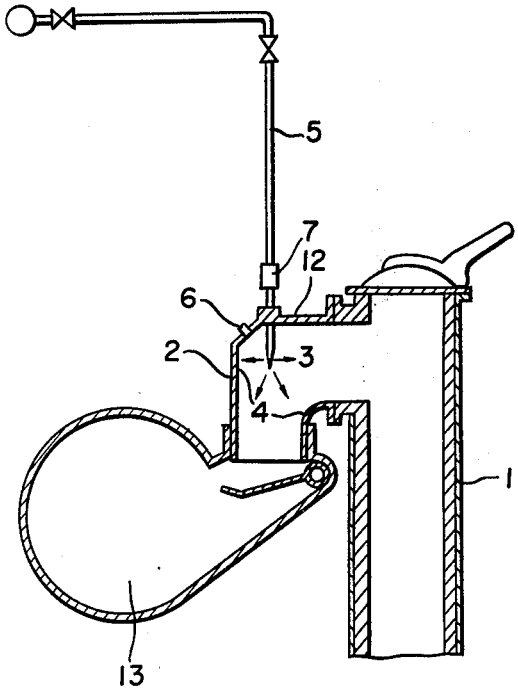
FIG. 3 is a vertical sectional side view of an ascension pipe of an OTTO type coke oven equipped with a sprinkler according to the invention.
Figure 4:
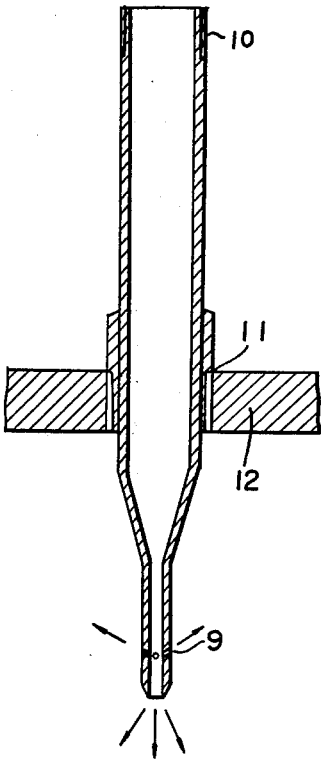
FIG. 4 is a vertical sectional side view of the nozzle of the sprinkler of FIG. 3, which is equipped mainly to the ascension pipe of an OTTO type coke oven according to the invention.

The sprinkler of FIGS. 1 and 2 is mainly used for the Kopper's type coke oven and the sprinkler of FIGS. 3 and 4 is ideal for the OTTO type coke oven. The fact has been understood from the practical operation. In the OTTO type, the diameter of the inner end of the sprinkler pipe (3) is reduced, without forming a shielding part (8), and the sprinkler holes (9) are formed on the reduced part of the sprinkler (3) in four upward slanting directions, whereby water is sprayed from the sprinkler pipe in four directions.

The sprinkler of the present invention is advantageous in such practical use without the troubles caused by the conventional apparatus.

Obviously many modifications and variations of the invention are possible in light of the teachings herein. It is therefore to be understood that within the scope of the appended claims, the invention may be practiced otherwise than as specifically described herein.

What is claimed as new and desired to be secured by Letters Patent of the United States is:

1. In a vent part of an ascension pipe of a coke oven, a sprinkler, disposed in a vent pipe for connecting a horizontal coke oven chamber and a collecting main pipe thereof to the outside, which comprises:

at least one sprinkler nozzle body in the form of a substantially straight pipe being fitted through a hole formed in the vent pipe and having a threaded portion formed on an outer wall of the sprinkler nozzle body adapted to be threadably secured to a threaded portion formed around the hole in the vent pipe;

one or more spray holes for spraying water in a substantially transverse direction to the axis of said nozzle body being formed at the inner end of said nozzle body extending into said vent pipe and a spray passage extending through an end portion of said straight nozzle disposed in said vent pipe;

the rear end of said nozzle body extending outside of said vent pipe being externally threaded; and a branch pipe which is branched from a main feed pipe supported on another member equipped on an oven roof being readily disconnectably connected to said rear end of said nozzle body through an internally threaded pipe joint member, wherein a straight nozzle having a reduced sectional area of passage is formed at the inner end of said nozzle body and said spray holes are formed in upwardly slanting directions on the side wall of the reduced sectional area of the inner end of said straight nozzle body to provide fluid spray to the upper portion of said vent pipe, and said coke oven is an OTTO type coke oven.

2. In a vent part of an ascension pipe of a coke oven, a sprinkler, disposed in a vent pipe for connecting a horizontal coke oven chamber and a collecting main pipe thereof to the outside, which comprises:

at least one sprinkler nozzle body in the form of a substantially straight pipe being disposed on an upper wall of the vent pipe fitted through a hole formed in said wall of the vent pipe and having a threaded portion formed on an outer wall of the sprinkler nozzle body adapted to be threadably secured to a threaded portion formed around the hole in the vent pipe;

an elongated spray hole for spraying water in a substantially transverse direction to the axis of said nozzle body being formed at the inner end of said nozzle body extending into said vent pipe and slanted with respect to said wall of said vent pipe to produce a spray which is slanted with respect to said wall;

the rear end of said nozzle body extending outside of said vent pipe being externally threaded; and a branch pipe which is branched from a main feed pipe supported on another member equipped on an oven roof being readily disconnectably connected to said rear of said nozzle body through an internally threaded pipe joint member, wherein the inner end of said nozzle body is sealed with a shielding part slanting with respect to said wall of said vent pipe and said spray hole is formed on the side surface of said inner end of said nozzle body, and said coke oven is a Kopper's type coke oven; whereby the slanted spray angle provides a more thorough distribution of the sprayed fluid on the wall of said vent pipe.

3. A sprinkler according to claim 2, wherein said at least one of said sprinkler nozzle bodies comprises at least one sprinkler nozzle body disposed on the upper and lower inner wall of said vent part of said ascension pipe.

* * * * *